US007428932B1

(12) United States Patent
Wintill et al.

(10) Patent No.: US 7,428,932 B1
(45) Date of Patent: Sep. 30, 2008

(54) COMPLETION SYSTEM FOR A WELL

(75) Inventors: Charles David Wintill, Houston, TX (US); Rodney Wayne Long, Cypress, TX (US); William Ryle Darnell, St. Martinville, LA (US); William John Darnell, Houston, TX (US); Michael Chad Darby, Katy, TX (US)

(73) Assignee: PetroQuip Energy Services, LLP, Houston, TX (US)

( * ) Notice: Subject to any disclaimer, the term of this patent is extended or adjusted under 35 U.S.C. 154(b) by 0 days.

(21) Appl. No.: 11/766,085

(22) Filed: Jun. 20, 2007

(51) Int. Cl.
*E21B 23/00* (2006.01)

(52) U.S. Cl. ..... 166/381; 166/380; 166/387; 166/242.6

(58) Field of Classification Search ..... 166/380, 166/381, 51, 387, 242.6
See application file for complete search history.

(56) References Cited

U.S. PATENT DOCUMENTS 6,983,796 B2 1/2006 Bayne et al.

*Primary Examiner*—Giovanna C Wright
(74) *Attorney, Agent, or Firm*—Buskop Law Group, PC; Wendy Buskop

(57) ABSTRACT

A completion system for a well including an upper production tubing disposed within a wellbore. An upper packer engaging the upper production tubing a top pin connector with seal assembly engaging the upper packer. A first intermediate production tubing disposed between the top pin connector with seal assembly and a top hydraulically operated tool.

41 Claims, 9 Drawing Sheets

COMPLETION SYSTEM FOR A WELL

FIELD

The present embodiments relate generally to a completion system for a well.

BACKGROUND

A need exists for an intelligent completion system for use inside a multi-zone hydrocarbon well.

There further exists a need for a completion system that uses a pin connector with seal assembly that can be pulled after use, taken apart, cleaned, and reused.

The present embodiments meet these needs.

BRIEF DESCRIPTION OF THE DRAWINGS

The detailed description will be better understood in conjunction with the accompanying drawings as follows.

Figure 1:
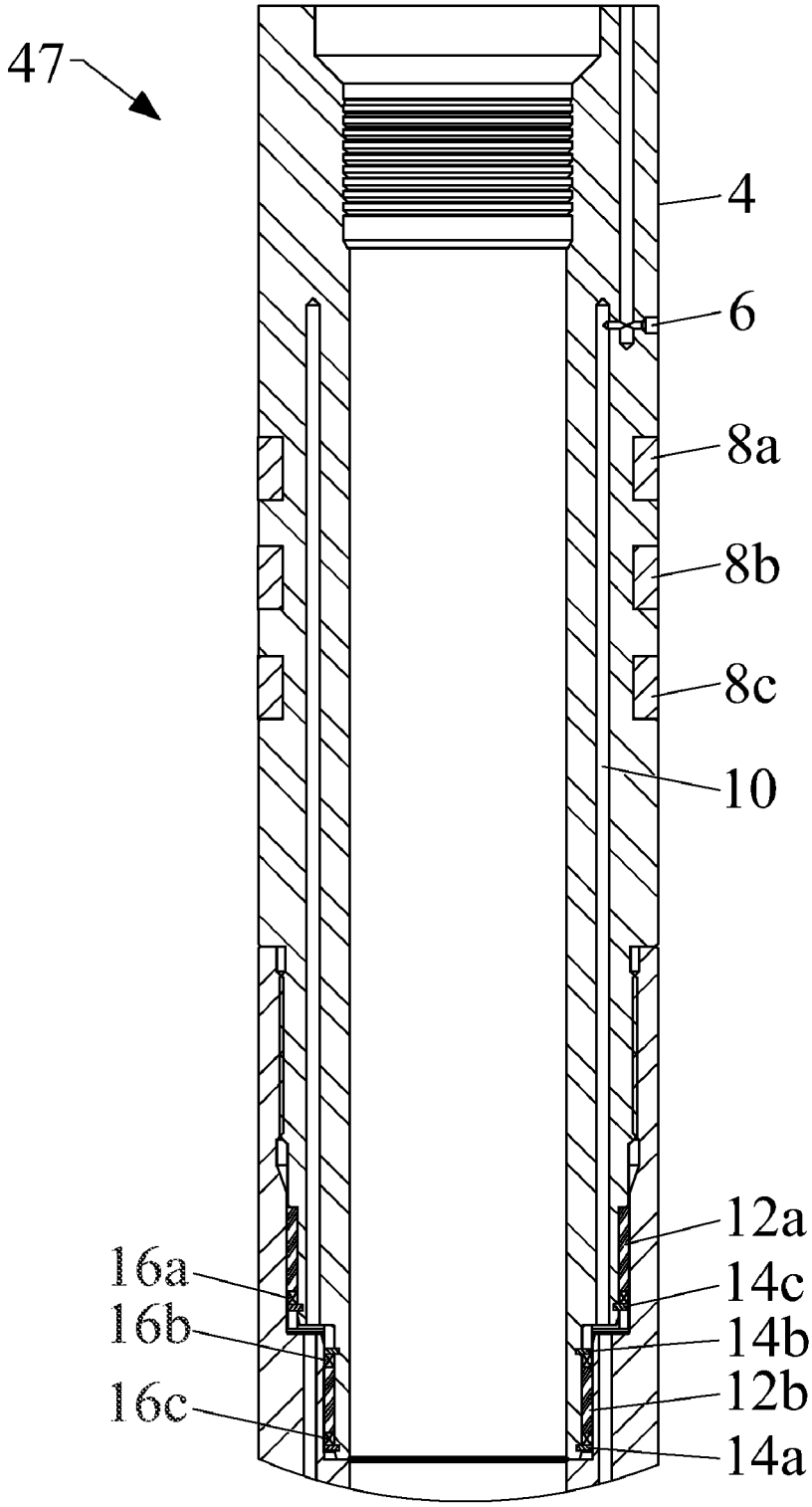
FIG. 1 depicts a cross sectional view of an embodiment of a seal assembly usable with the well completion system.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The embodiments of the invention generally relate to a completion system for a well.

A first embodiment of the well completion system can include an upper production tubing disposed with in a wellbore. An upper packer can engage the upper production tubing. A top pin connector with seal assembly can engage the upper packer.

The pin connector can be formed from a tubular having an upper tubular portion and a lower tubular portion.

The lower tubular portion has an upper tubular body and a lower tubular body with a lower tubular body face.

A first pin engages the wet connect assembly. The first pin has a first pin outer surface, which can be connected to the wet connect assembly.

In a second embodiment, a double pin is in the lower tubular portion. The double pin engages the wet connect assembly. In the double pin embodiment, a second pin concentrically surrounds the first pin forming a double pin connector. The double pin connector is particularly useful in packers such as those adapted for multi zone gravel packing in hydrocarbon wells.

In either the single pin or double pin version of the pin connector with seal assembly, a control line connector, such as a jam nut, is used on the first pin outer surface and the lower tubular body face.

At least one alignment key is formed in at least a part of the tubular body. The alignment key can be disposed on an inner diameter of the tubular body and can extend from a top portion of the lower tubular body toward a mid section of the lower tubular body. The alignment key, in an embodiment, is formed at an angle from the top, sloping in a curve, such as a sine curve along the lower tubular body. The alignment key extends no more than 10% the length of the lower tubular body.

In an alternative embodiment of the pin connector with seal assembly, the at least one alignment key can be disposed on an interior wall of the tubular body portion. Multiple alignment keys can be used on one tubular body portion for a secure locking engagement.

The lower tubular body has a lower hydraulic flow path formed within the lower tubular body for flowing controlled hydraulic fluids. This lower hydraulic flow path communicates on one end with a hydraulic wet connector.

Additionally, a two part locking mechanism can be used to connect the upper tubular portion to the lower tubular portion. In an embodiment, one part of the locking mechanism has a collar. The collar can be threaded or force fit to the second part of the locking mechanism. Additionally, a lower tubular seal can be disposed between the collar and the lower tubular portion to ensure a snug, leak-tight fit.

The two part locking mechanism can be used to secure the upper tubular portion or the seal assembly to another piece of well equipment.

The second part of the locking mechanism is a locking key. The locking key is engaged by a shear pin. The shear pin further engages a lower key retainer. The locking key is also engaged using an upper key retainer. The upper key retainer engages the upper tubular portion. The upper portion of the locking mechanism has at least one fastener, such as a screw, to secure the upper portion of the locking mechanism. A force is exerted on the upper tubular portion and the locking key by a mechanism, such as a coiled spring, a wave spring, or similar force applying mechanism.

The upper tubular portion is removeably connected to the lower tubular portion, such as with force fit connection or stabbed in connection. It is also contemplated that the upper tubular portion can be stabbed into the lower tubular portion for a secure connection, such as a body lock ring.

The upper tubular portion has a receiving hydraulic wet connector, which removably engages the extending hydraulic wet connector of the lower tubular portion.

In an embodiment, the receiving hydraulic wet connector is a quick release hydraulic wet connector, which is particularly useful in an emergency, such as when there is an excessive pressure build up and there is a need for a fast release.

An intermediate hydraulic flow path is also formed in the upper tubular body. The intermediate hydraulic flow path fluidly engages the lower hydraulic flow path.

At least one alignment groove is formed on the upper tubular body. The alignment groove is for receiving at least one alignment key. At least one alignment key is formed in the upper tubular body, and an alignment groove is formed in the lower tubular portion for receiving the at least one alignment key.

In the present embodiment of the pin connector with seal assembly, the upper tubular portion removably engages a seal assembly. The seal assembly can include a tubular seal assembly body. In the tubular seal assembly an upper hydraulic flow path can be formed which fluidly engages the intermediate hydraulic flow path.

Between the tubular seal assembly body and the upper tubular body there can be a plurality of upper hydraulic flow path seals. The hydraulic flow path seals are contemplated to be non-elastomeric, such as metal to metal seals. The hydraulic flow path seals can have different diameters from each other. In another embodiment, the hydraulic flow path seals are all the same diameter.

A plurality of upper concentric seals can be positioned, such that they form a sealing engagement around the upper hydraulic flow path seals. A sealing engagement can be formed in the upper hydraulic flow path by using a plurality of seal assembly fasteners to apply a force to the upper hydraulic flow path seals. An example of a seal assembly fastener is a snap ring. The seal assembly fasteners can be made from any alloy steel readily available from Smalley Spring Company, Chicago, Ill.

In an embodiment at least one seal ring can be used for supporting, such as rigidly supporting, at least one upper hydraulic flow path seal. The seal ring can be made from a plastic or alloy steel.

A hydraulic flow path plug can be used to provide a sealing engagement with the upper hydraulic flow path and the tubular seal assembly body. The plug can have a diameter of between 0.032 inches and 0.500, and a length of between 0.125 and 0.562.

The pin connector with seal assembly can be used within a packer to form an integrated wet connect assembly. The integrated wet connect assembly preferably engages a valve and production tubing on one end and another seal assembly on the other end of the integrated wet connect assembly.

The embodiments of the pin connector with seal assembly reduce installation time and the costs associated with downhole hydrocarbon production.

An embodiment of the pin connector with seal assembly provides downhole well equipment that is more efficient because there is no field assembly required.

An embodiment of the pin connector with seal assembly can be assembled at a remote location, and can be ready for immediate use upon reaching the field.

An embodiment of the pin connector with seal assembly is a well containment feature because the downhole assembly is stung in or engaging the well. Thereby, isolating the well and preventing well bore fluid from leaking into the annulus above the packer, preventing a well control situation. The seal assembly prevents fluid from leaking into the environment and contaminating water tables.

The present embodiment of the well completion system can include a first intermediate production tubing engaging the top pin connector with seal assembly and a top hydraulically operated tool. A top control line can be secured to a power source and the top pin connector with seal assembly.

The first intermediate production tubing intermediate can be secured to a bottom pin connector with seal assembly and the top hydraulically operated tool.

A second intermediate production tubing is disposed between the top hydraulically operated tool and an intermediate packer. A third control line can be in fluid communication with the top hydraulically operated tool and an upper tubular portion of an intermediate pin connector with seal assembly. The intermediate pin connector with seal assembly engages the intermediate packer.

A fourth control line is secured to the lower tubular portion of the intermediate pin connector and the bottom hydraulically operated tool.

In the present embodiment of the completion system for a well a first bottom production tubing can engage the bottom hydraulic operated tool and the intermediate pin connector with seal assembly.

A second bottom production tubing engages the bottom hydraulically operated tool and a lower sealing means.

It is contemplated that the present embodiment of the invention can be adapted to accommodate a well having more zones by placing a plurality of pin connectors with seal assemblies between the top pin connector with seal assembly and the bottom pin connector with seal assembly.

In a second embodiment of the completion system for a well the completion system can be adapted for use with a gravel pack.

The completion system for the gravel pack well can include an upper production tubing engaging an upper packer. An upper pin connector with seal assembly can engage the upper packer.

In the present embodiment the pin connectors with seal assembly are adapted for use with the gravel pack by having a second pin the concentrically surrounds the first pin.

In the present embodiment of the well completion system for a gravel pack well the upper tubular portion of the top pin connector with seal assembly can be connected to the upper packer. A top external blank pipe and a top internal blank pipe can also connect to the lower tubular portion of the top pin connector with seal assembly.

A first control line can be in communication with a power source and a upper tubular portion of a top pin connector with seal assembly. The lower portion of the top pin connector is secured to a second control line.

A top hydraulically operated tool can be in communication with the second control line. The second control line can periodically control the top hydraulically operated tool. The top hydraulically operated tool can be connected to the top external blank pipe.

A top well screen can be secured to the top external blank pipe. A top external seal assembly can engage the top external blank pipe and a top intermediate packer.

A first intermediate blank pipe is connected to the top hydraulically operated tool. The upper tubular portion of an intermediate pin connector with seal assembly can engage the intermediate packer.

A third control line connects to the top hydraulically operated tool and the upper tubular portion of the intermediate pin connector with seal assembly.

The lower tubular portion of the intermediate pin connector with seal assembly is connected to a first intermediate external blank pipe and a second intermediate internal blank pipe connected to a bottom hydraulically operated tool.

A bottom internal blank pipe connects to the bottom hydraulically operated tool and a bottom isolation seal assembly.

A fourth control line can connect to the lower tubular portion of the intermediate pin connector and the bottom hydraulically operated tool.

A lower well screen is secured to the first intermediate external blank pipe. A seal assembly with a polished bore is secured to the lower well screen and secured within a lower sealing means.

In a contemplated embodiment the well completion system can be adapted for use with a gravel pack well having an infinite number of zones by disposing a plurality of pin connectors with seal assembly between the top pin connector with seal assembly and the bottom pin connector with seal assembly.

The embodiments of the invention can be best understood with reference to the figures.

Referring now to FIG. 1, which depicts an embodiment of a seal assembly 47. The seal assembly 47 includes a tubular seal assembly body 4, a hydraulic flow path plug 6, an upper hydraulic flow path 10 formed in the tubular seal assembly body 4, a first seal ring 16*a*, a second seal ring 16*b*, and a third seal ring 16*c*, a first upper hydraulic flow path seal 12*a*, a second hydraulic flow path seal 12*b*, a first seal assembly fastener 14*a*, a second seal assembly fastener 14*b*, a third seal assembly fastener 14*c*, a first upper concentric seal 8*a*, a second upper concentric seal 8*b*, and a third upper concentric seal 8*c*.

The tubular seal assembly body 4 can be made from alloy steel, and can have a length ranging from 10 inches to 36 inches, a diameter ranging from 2.688 inches to 6 inches. The seal assembly body 4 is depicted having the hydraulic flow path plug 6, such as a lee plug from Lee Company in Connecticut. The hydraulic flow path plug 6 provides a seal for the upper hydraulic flow path 10.

The hydraulic flow path can have a volumetric flow rate equivalent to the capacity of a 0.25 inch control line. The hydraulic flow path can be formed into the tubular seal assembly by inserting a hydraulic line with a diameter ranging from 0.25 inches to 0.5 inches.

The first seal ring 16*a* can support a first hydraulic flow path seal 12*a* and be made from an alloy steel or non elastomeric material, such as a rigid polyethylene seal ring or rigid polyethylene/polypropylene copolymers.

The second seal ring 16*b* can support the second hydraulic flow path seal 12*b*. The first seal ring 16*a* and the second seal ring 16*b* provide support to the hydraulic flow path seals 12*a* and 12*b*.

The first hydraulic flow path seal 12*a* and the second hydraulic flow path seal 12*b* can be similar to each other or in the alternative the first and second hydraulic flow path seals 12*a* and 12*b* can be different. The first and second hydraulic flow path seals 12*a* and 12*b* can have a diameter ranging from 1.9 inches to 6.75 inches. The flow path seals can be made from non elastomeric materials, such as polymer plastics, including poly ethyl ketone (PEEK), or other materials.

The first seal ring 16*a*, the second seal ring 16*b*, and the third seal ring 16*c* can be similar in design or in the alternative each seal ring can be made from a different material. The diameters of each seal ring can be similar or different.

The first seal assembly fastener 14*a* can be a threaded cap. The second seal assembly fastener 14*b*, which can be similar to the first seal assembly fastener 14*a*. The fasteners are adapted to retain the second upper hydraulic flow path seal 12*b*.

The third seal assembly fastener 14*c*, which can be similar to the second seal assembly fastener 14*b*, which can be similar to the first seal assembly 14*a*.

It is possible to have an embodiment wherein the first seal assembly fastener, the second seal ring fastener, the third seal ring fastener can be made from steel.

The first, second and third concentric seals 8*a*, 8*b*, and 8*c* can be an elastomeric or non-elastomeric seal. Greene Tweed from Houston Tex. supplies usable concentric seals for this embodiment. The first concentric seal 8*a*, the second concentric seal 8*b*, and the third concentric seal 8*c* can be similar to each other.

Figure 2:
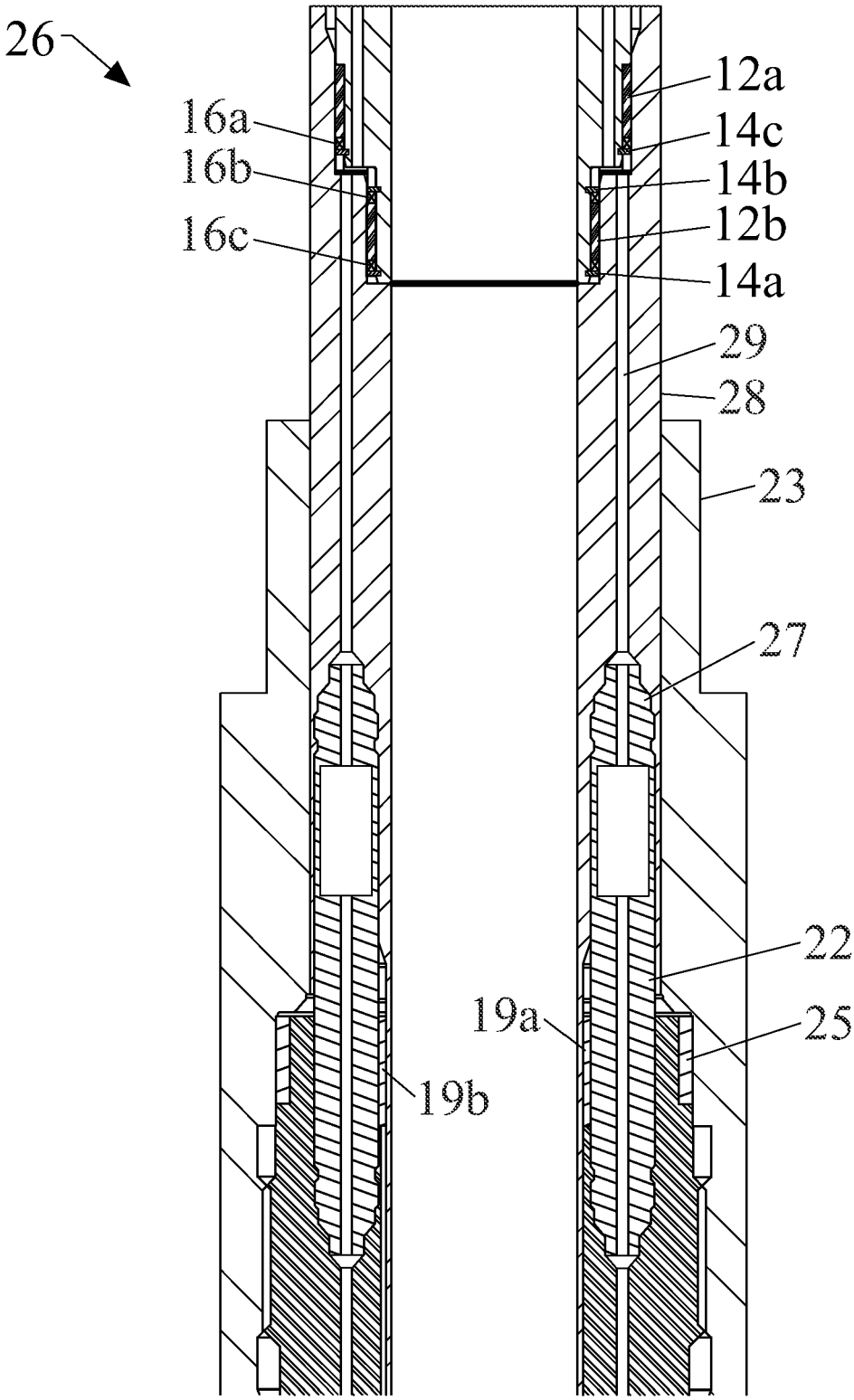
FIG. 2 depicts a cross sectional view of an embodiment of an upper tubular portion for an embodiment of the well completion system.

Turning now to FIG. 2 the upper tubular portion 26 is depicted. The upper tubular portion 26 has an upper tubular body 28 that removably engages the seal assembly 47. The seal assembly 47 is best depicted in FIG. 1. The upper tubular body 28 can be made from alloy steel, and have a length ranging from 2 feet to 6 feet.

Returning to FIG. 2, the upper tubular portion 26 is depicted having an intermediate hydraulic flow path 29. The intermediate hydraulic flow path can have an inner diameter from 0.125 inches to 0.5 inches. In the alternative embodiment, the intermediate hydraulic flow path can be a machined port. The intermediate hydraulic flow path 29 is in fluid communication with the upper hydraulic flow path 10. The upper hydraulic flow path 10 is depicted in FIG. 1.

The intermediate hydraulic flow path 29 and the upper hydraulic flow path 10 are coupled together, for example using the seals.

Figure 3:
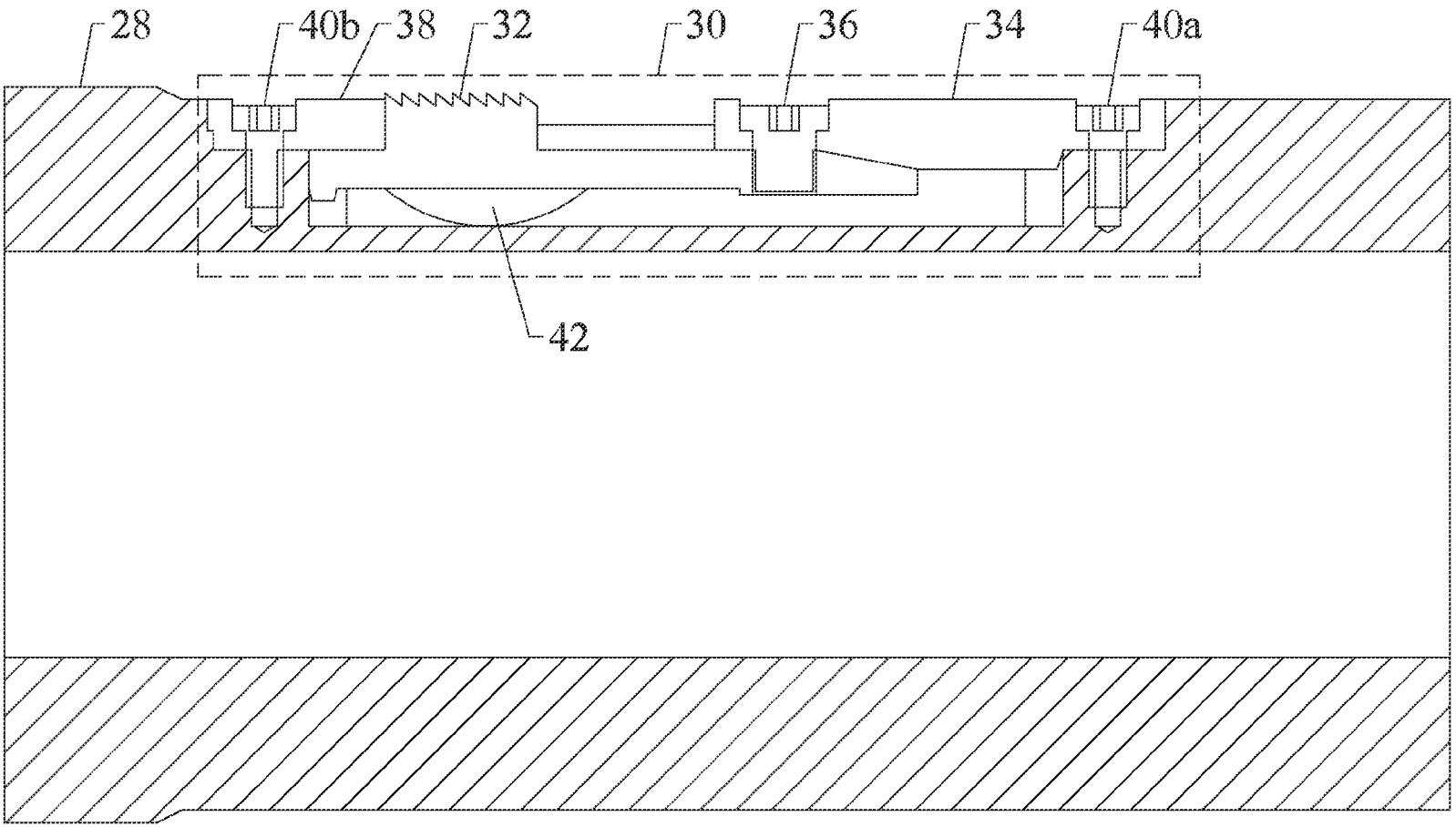
FIG. 3 depicts a detailed cross sectional view of a locking mechanism for use with the well completion system.

Referring now to FIG. 3, the upper tubular body 28 is connected to an upper portion 30 of an exemplary locking mechanism. The upper portion 30 is depicted having a shear pin 36, such as a brass or annealed steel shear pin, such as those available from Shamrock Fasteners of greater Houston, Tex.

A locking key 32 is machined as part of the overall pin and seal assembly in to the upper tubular of the lower tubular portion or both. The locking key is a combination of grooves and projections that interlock together.

A lower key retainer 34 is a machined part used for holding the locking key in either the locked or unlocked position. In an embodiment, the lower key retainer can be a circular part with a diameter larger than the annulus of the bore of the tool. The retainer can be a segment, such as a "D" shape or an open "D" shape.

An upper key retainer 38 can be similar to the lower key retainer. In an embodiment, the upper key retainer can be a circular part with a diameter larger than the annulus of the bore of the tool. The upper key retainer can be a segment, such as a "D" shape or an open "D" shape.

The mechanism for providing force 42 can be a coiled spring, a wave spring, or a similar force providing mechanism. If a coiled spring is used, it can be one provided by Suhm of Houston, Tex.

The shear pin 36 engages the locking key 32 and the lower key retainer 34. The shear pin 36 can be a solid cylinder with a centrally aligned through hole. The shear pin 36 can be made from steel, stainless steel, or similar materials.

The upper key retainer 38 can have a channel, with a depth ranging from 0.5 inches to 1 inches adapted for receiving the locking key 32.

The upper portion 30 is secured to upper tubular portion 26 by the first fastener 40*a* and the second fastener 40*b*. The first fastener 40*a* and the second fastener 40*b* can be planarly aligned with each other. It is possible to use more than two fasteners to secure the upper locking mechanism to the upper tubular portion 26.

The mechanism for exerting force 42 interacts with the locking key 32 and the upper tubular portion 26.

The interaction of the mechanism for exerting force 42 with the locking key 32 and the upper tubular portion 26 provides the benefit of providing retraction in and out, an axial force when the lower tubular portion is driven into the well, in a ratcheting unidirectional motion.

Returning to FIG. 2, a fastener 23 can be located on the upper tubular portion of the pin and seal assembly, for securing to a piece of well equipment, wherein the piece of well equipment can be a packer, or another type of well equipment.

The fastener 23 can be a collar for engaging a locking mechanism, such as the upper portion 30 and anchoring the upper tubular portion to another piece of well equipment.

FIG. 2 further depicts a lower tubular seal 25 which is disposed between the collar 23 and the lower tubular portion 21. The lower tubular seal 25 can have a diameter ranging from 1.9 inches to 6 inches. The lower tubular seal 25 can be made from plastic, elastomeric material or a non-elastomeric material to create seals.

The upper tubular portion has a receiving hydraulic wet connector 27, for example, a wet connect; such as a SEA-PORT™ wet connects made by Diamould from the United Kingdom; can be used. The receiving hydraulic wet connector 27 removeably engages an extending hydraulic wet connector 22, which can also be made by Diamould. The receiving hydraulic wet connector 22 is supported by the upper tubular body 28.

The upper tubular body 28 supports the receiving hydraulic wet connector 22 by creating a threaded engagement with the receiving hydraulic wet connector 22.

FIG. 2 depicts a first alignment key 19*a*, and a second alignment key 19*b*, which is similar to the first alignment key 19*a*. The alignment keys are machined parts that are at least partially disposed on the lower tubular body 21.

Although the embodiment in FIG. 2 depicts two alignment keys, it is possible to have more than two alignment keys or less than two alignment keys, as long as there is at least one alignment key. In an alternative embodiment, the alignment keys can differ from each other. In length and thickness. For example one alignment key can have a length of ¼ inch and the second alignment key can have a length of 10 inches.

Figure 4A:
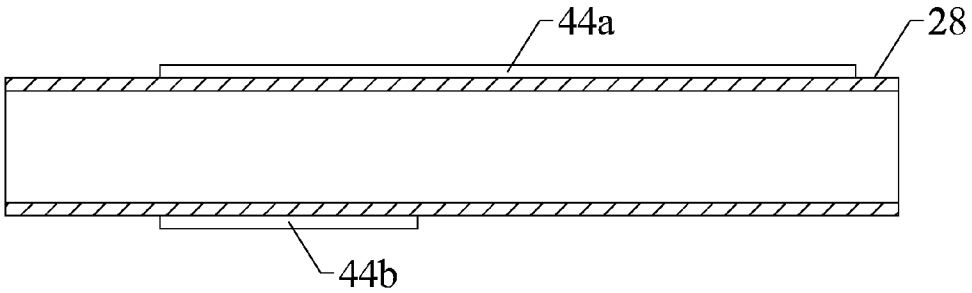
FIG. 4*a* depicts a cross sectional view of an embodiment of an upper tubular body with at least one alignment groove that is usable with the embodiments of well completion system.
Figure 4B:
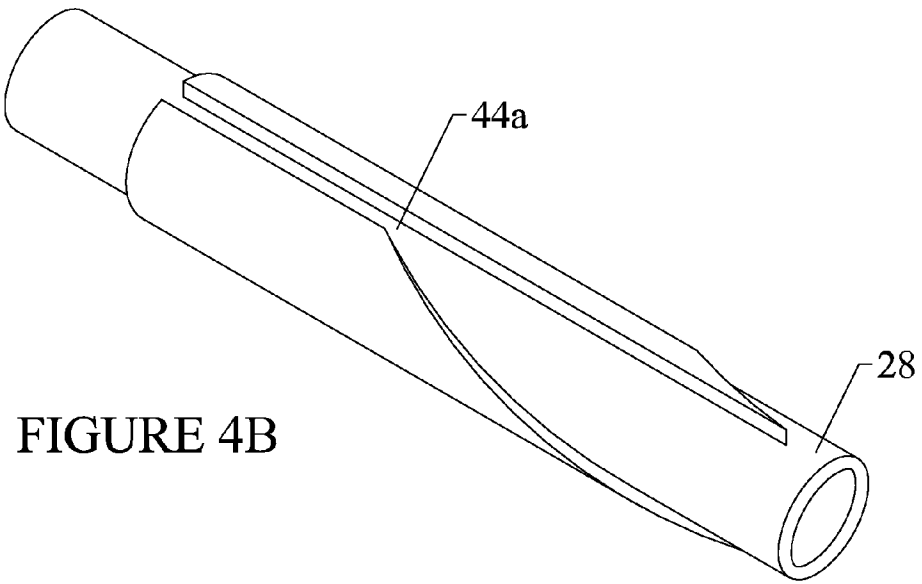
FIG. 4*b* is a perspective view of the upper tubular body with the alignment groove usable with the well completion system.

Turning now to FIGS. 4*a* and 4*b*, which depict a first alignment groove 44*a* and a second alignment groove 44*b* formed on the upper tubular body 28. The first alignment groove 44*a* receives either alignment key 19*a* and the second alignment groove 44*b* receives either alignment key. There should be at least one alignment groove.

The first alignment groove 44*a* and the second alignment groove 44*b* can have a depth ranging from 0.30 inches to 0.05 inches. The alignment grooves can be molded, machined, or forged into the upper tubular body 28.

Figure 5:
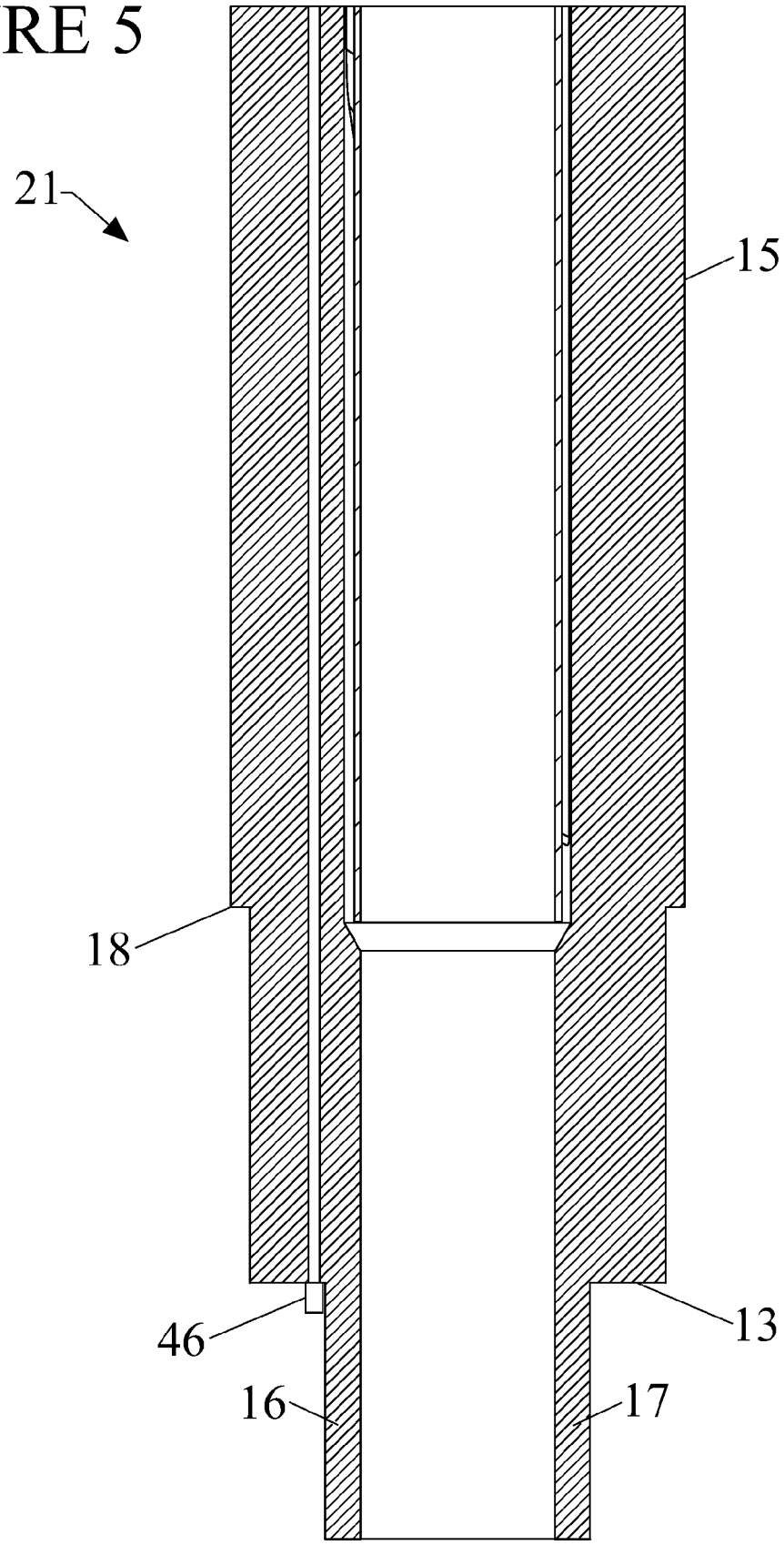
FIG. 5 depicts a cross sectional view of an embodiment of a lower tubular portion for an embodiment of the pin connector with seal assembly.

Turning now to FIG. 5, which depicts an embodiment of the lower tubular portion 21. The lower tubular portion 21 has a lower tubular body 15. The lower tubular body 15 can have a length ranging from 2 feet to 6 feet, and an outer diameter ranging from 2 inches to 15 inches.

A lower hydraulic flow path 20 is formed into the lower tubular body 15. The lower hydraulic flow path 20 fluidly engages the intermediate hydraulic flow path 29. The fluid engagement is enabled by a coupling.

The lower hydraulic flow path 20 can be a port machined into the lower tubular body 15.

In a typical embodiment of the invention each of the hydraulic flow paths have the same hydraulic fluid and the same flow rate.

The lower tubular body has a lower tubular body face 13. The lower tubular body face 13 can have a flange angle ranging from 30 degrees to 90 degrees. The lower tubular body face 13 can be made from a metal adapted to survive a highly corrosive environment.

The lower tubular portion further has a first pin 16. The pin 16 can be manufactured by Pertroquip Energy Services of Broussard La. and Houston Tex. The first pin 16 can have a length ranging from 3 inches to 9 inches. The first pin 16 can have a cylindrical shape and can be solid or hollow.

The first pin 16 has a first pin outer surface 17. The first pin outer surface can be a metal, a composite, or a similar material. The first pin outer surface 17 in a typical embodiment will be made form the same material of the first pin 16.

In the embodiment depicted in FIG. 5, a second pin 18. The second pin 18 concentrically surrounds the first pin 16. In the embodiment in FIG. 5 a double pin connector is formed using the first and second pins. The double pin connector can be adapted for multi zone gravel packing in a hydrocarbon well. It should be noted that the two pin embodiment is not required, and that it is possible for an embodiment of the invention to have only a first pin 16.

FIG. 5 depicts a control line connector 46 disposed between the first pin outer surface 17 and the lower tubular body face 13. The control line connector 46 can be adapted to handle a fluid pressure ranging from 2,000 psi to 20,000 psi.

Figure 6A:
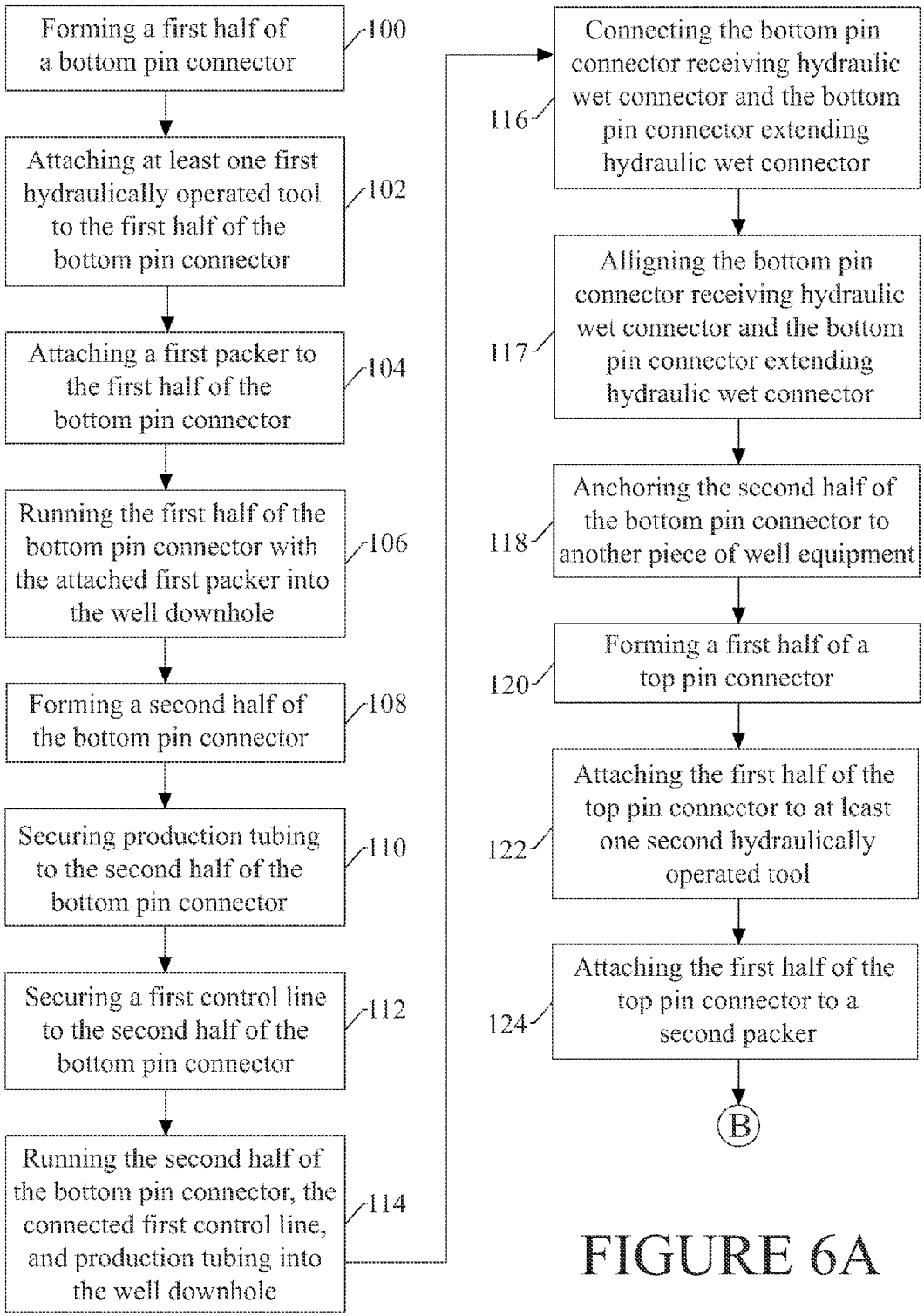
FIG. 6A depicts a flow diagram for a method for installing an embodiment of the well completion system.
Figure 6B:
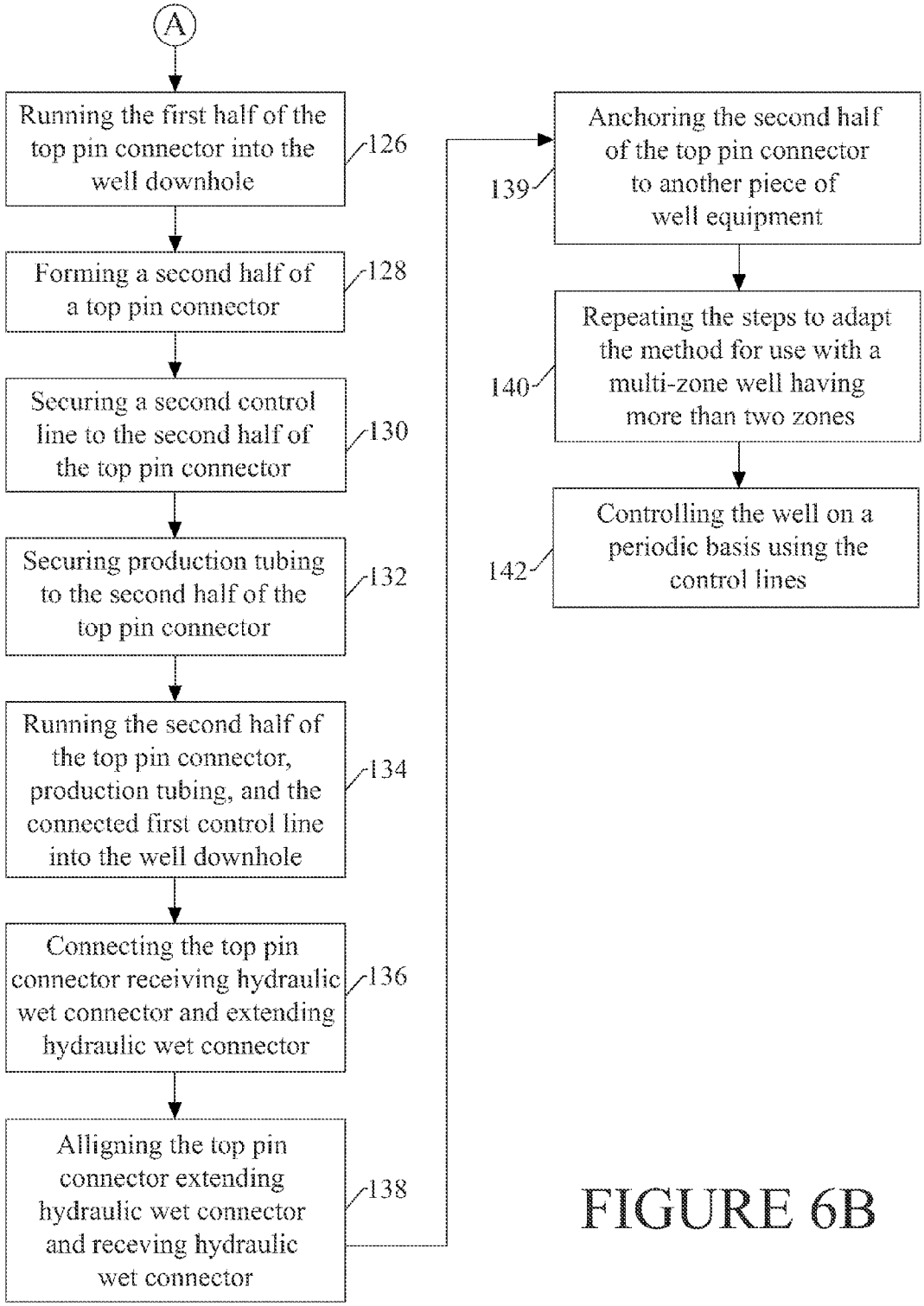
FIG. 6B is a continuation of the flow diagram for the method for installing an embodiment of the well completion system.

FIGS. 6A and 6B depicts an embodiment of the method. The step of forming a first half of a bottom pin connector by securing a bottom pin connector extending hydraulic wet connector to a lower tubular portion is depicted as step 100. The lower tubular portion can include a lower tubular body, a first pin, and a lower hydraulic flow path. An embodiment of the first half of a pin connector is depicted above in FIG. 5.

The method further includes step 102 attaching the first half of the bottom pin connector to at least one first hydraulically operated tool. The first half of the top pin connector can be attached to the hydraulically operated tool using a port, a quick connect, a control line, or similar means of connecting to a hydraulically operated tool.

In step 104 the method is depicted including attaching a first packer with a bore to the first half of the bottom pin connector. The packer can be attached to the first half of the bottom pin connector by using fasteners or other removable securing means.

The first half of the bottom pin connector with the attached first packer is run into the well downhole in step 106.

The present embodiment of the method includes forming a second half of a bottom pin connector in step 108. The second half of the bottom pin connector is formed by securing a bottom pin connector receiving hydraulic wet connector to an upper tubular portion with a seal assembly. The upper tubular portion with seal assembly is depicted in FIG. 1 and FIG. 2.

The second half of the bottom pin connector is secured to production tubing in step 110. The production tubing can have a length ranging from 30 feet to 20,000 feet. A first control line having an inside diameter ranging from 0.125 to 0.475 inches is secured to the second half of the bottom pin connector in step 112.

In step 114 the production tubing the second half of the bottom pin connector, and the connected first control line is run into the well downhole. The bottom pin connector receiving hydraulic wet connector is connected to the bottom pin connector extending hydraulic wet connector in step 116. The bottom pin connector receiving wet connector and the top pin connector extending hydraulic wet connector can be quick release wet connectors.

The present embodiment of the method includes step 117, aligning the bottom pin connector hydraulic extending wet connector and the bottom pin connector receiving hydraulic wet connector. The alignment can be accomplished using at least one alignment key and one alignment groove.

The second half of the bottom pin connector is anchored to another piece of well equipment in step 118. The anchoring can be performed using a locking mechanism. The locking mechanism can be similar to the one depicted in FIG. 3.

In step 120 a first half of a top pin connector is formed by securing a second extending hydraulic wet connector to a top pin connector lower tubular portion. The top pin connector lower tubular portion is similar to the lower tubular portion of the bottom pin connector.

The first half of the top pin connector is attached to at least one second hydraulically operated tool, the second half of the bottom pin connector, or combinations thereof in step 122. In step 124 a second packer with a bore is attached to the first half of the top pin connector.

In step 126 the first half of the top pin connector with the attached second packer is ran into the well downhole.

In step 128 a second half of a top pin connector is formed by securing a top pin connector extending hydraulic wet connector to a top pin connector upper tubular portion. The top pin connector upper tubular portion is similar to the bottom pin connector upper tubular portion.

The first control line fluidly communicates with the first half of the top pin connector, the first hydraulically operated tool, and the second hydraulically operated tool.

A second control line is connected to the second half of the top pin connector to for connecting to a hydraulic source in step 130. The hydraulic source can be a hydraulic tank located on a surface, remote from the well. The second control line is in fluid communication with the bottom pin connector, the first hydraulically operated tool, and the second hydraulically operated tool, and the power source.

A second production tubing is secured to the second half of the top pin connector in step 132. The second production tubing can be similar to the first production tubing. In Step 134 the production tubing with the connected second half of the top pin connector and the connected second control line is ran into the well.

The top pin connector receiving hydraulic wet connector can be connected to the top pin connector extending hydraulic wet connector in step 136. The present embodiment of the method includes step 138 aligning the top pin connector hydraulic extending wet connector and the top pin connector receiving hydraulic wet connector. The alignment can be accomplished using at least one alignment key and one alignment groove.

In step 139 the second half of the top pin connector is anchored to another piece of well equipment.

each of the upper hydraulic flow paths and intermediate hydraulic flow paths can be sealed using a plurality of upper hydraulic flow path seals between each tubular seal assembly body and each upper tubular body.

A means for retaining the upper hydraulic flow path seals can be provided. The retaining can be accomplished by using a plurality of seal assembly fasteners.

The method can further include supporting at least one of the hydraulic flow path seals using at least one seal ring.

The present embodiment of the method can include preventing hydraulic fluid from escaping each of the hydraulic flow paths using at least one hydraulic flow path plug for each pin connector with seal assembly.

In step 140 the above steps can be repeated to adapt the method for use with a multi-zone well having more than two zones.

The present embodiment of the invention includes step 142 which is controlling the well, using the control lines, on a periodic basis. The periodic basis is defined as activating the well for a time ranging form 2 minutes to 120 minutes. The batch basis is equivalent to the periodic basis.

The present embodiment of the method can be adapted for use with a gravel pack using a second pin surrounding the first pin in each lower tubular portion forming a double pin connecter.

Figure 7:
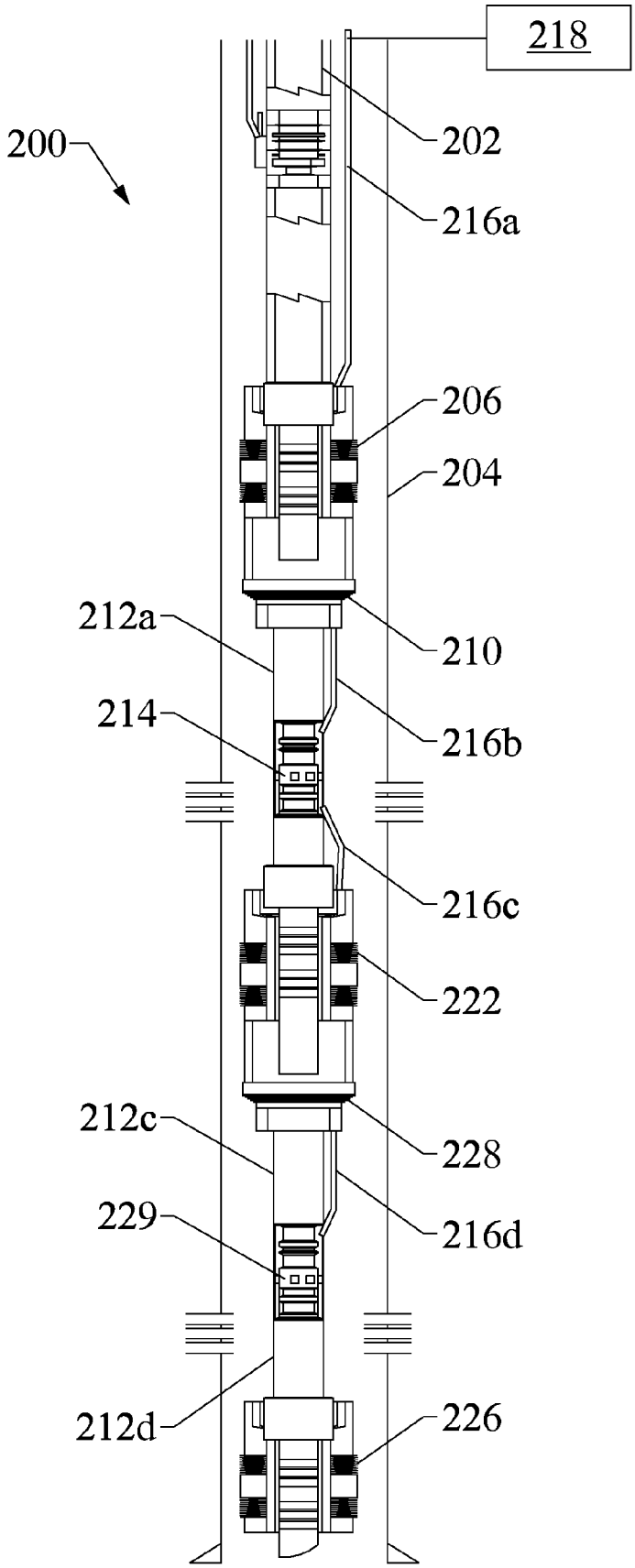
FIG. 7 depicts an embodiment of an assembled well completion system.

FIG. 7 depicts an embodiment of the completion system for a well 200. The completion system for the well 200 can include an upper production tubing 202. The upper production tubing 202 can have an inner diameter ranging from 1.9 inches to 7 inches. The upper production tubing 202 can be disposed in a wellbore 204. An upper packer 206 can engage the upper production tubing 202.

The upper packer 206 can be engaged by a top pin connector with seal assembly 210. An example of the top pin connector with seal assembly 210 can be seen in FIGS. 1-5.

The top pin connector can engage an intermediate production tubing 212*a*. The intermediate production tubing 212*a* can be similar to the top production tubing.

A top hydraulically operated tool 214 is depicted engaging the intermediate production tubing 212*a*. The top hydraulically operated tool 214 can be a single line sleeve, a valve, or a similar downhole tool.

A top control line 216*a* is secured to a power source 218. The power source 218 can be a remote hydraulic tank, a pressurized tank, a fluid reservoir, or a similar fluid containment device. The upper tubular portion of the top pin connector with seal assembly 210 is in fluid communication with the top control line 216*a*.

The first intermediate production tubing 212*a* is secured to the lower tubular portion of the top pin connector with seal assembly 210 and the top hydraulically operated tool 214. A second control line 216*b* is connected to the lower tubular portion of the top pin connector with seal assembly 210 and the top hydraulically operated tool 214.

An intermediate packer 222 is depicted engaging the second intermediate production tubing 212*b*.

A third control line 216*c* is in fluid communication from the top hydraulically operated tool 214 to a upper tubular portion of the intermediate pin connector with seal assembly 228. A fourth control line 216*d* is in communication with the lower tubular portion of the intermediate pin connector with seal assembly 228 and a bottom hydraulically operated tool 229. The second bottom control line 216*d* can be used to periodically operate the bottom hydraulically operated tool 229. A first bottom production tubing 212*c* is disposed between the intermediate pin connector with seal assembly and the bottom hydraulically operated tool 229.

A second bottom production tubing 212*d* is depicted engaging the bottom hydraulically operated tool 229 and a lower sealing means 226. The lower sealing means 226 can be a packer, a plug, or similar sealing means.

Figure 8:
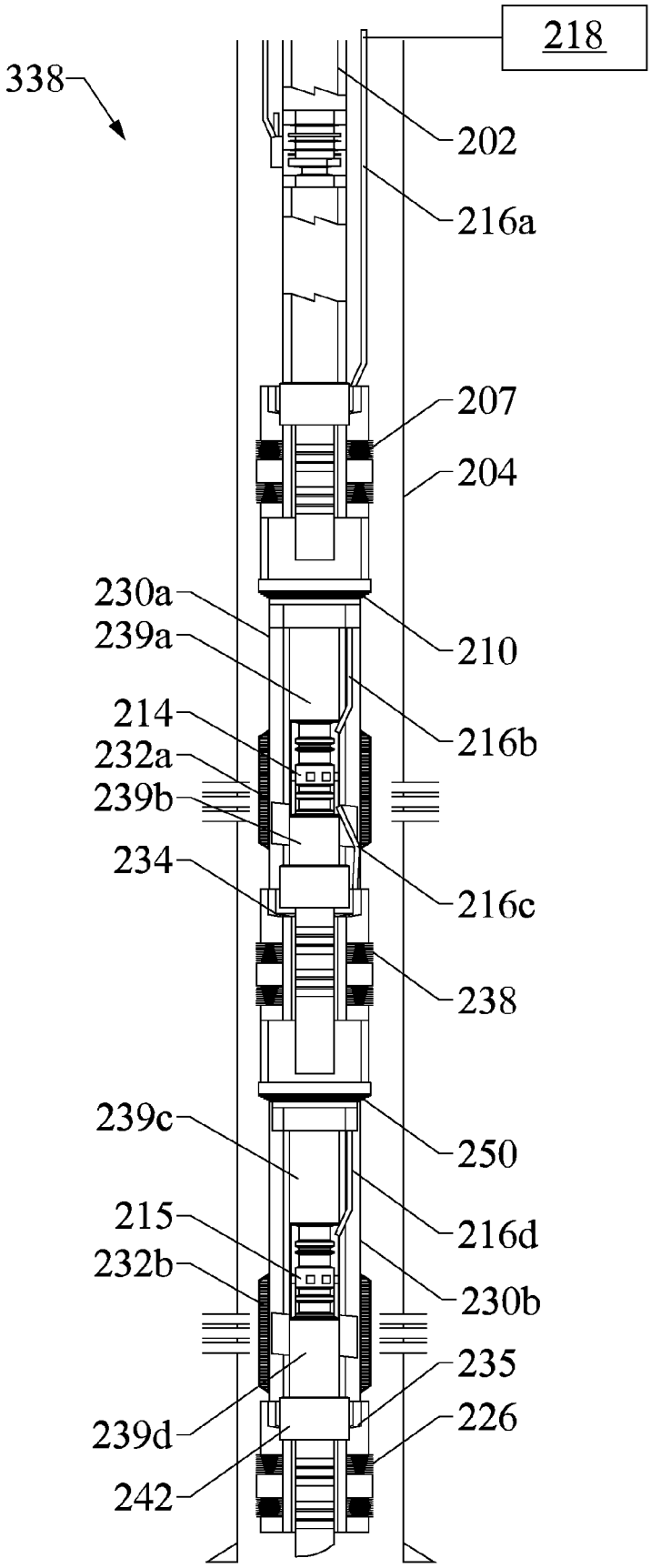
FIG. 8 depicts an embodiment of an assembled well completion system adapted for use with a gravel pack.

FIG. 8 depicts an embodiment of a completion system for a gravel pack well 328. An upper production tubing 202 is disposed within a wellbore 204. An upper gravel packer 207 is depicted engaging the upper production tubing 202.

A top pin connector with seal assembly 210 is depicted engaging the upper gravel packer 207.

The lower tubular portion of the top pin connector with seal assembly 210 is connected to a top external blank pipe 230*a*; and a top internal blank pipe 239*a*.

The lower portion of the top pin connector with seal assembly 210 can be connected to the top internal blank pipe 239*a* and the external blank pipe 230*a* by a threaded connection. The top internal blank pipe 239*a* can be similar to the production tubing. The top external blank pipe 230*a* can be similar to the production tubing.

A first control line 216*a* is connected to the upper tubular portion of the top pin connector 210 and a power source 218. The lower tubular portion of the top pin connector with seal assembly is secured to a second control line 216*b*.

A top hydraulically operated tool 214 is connected to the top blank pipe and is in communication with the second control line 216*b* communicating with the power source 218 for periodically controlling the top hydraulically operated tool 214.

A top well screen 232*a* is secured to the top external blank pipe 230*a*. The top well screen 232*a* can be slotted or ribbed.

First intermediate internal blank pipe 239*b* is connected to the top hydraulically operated tool 214 and the top portion of the intermediate pin connector with seal assembly 250. A third control line 216*c* connects the top hydraulically operated tool 214 with the upper tubular portion of the intermediate pin connector with seal assembly 250.

A top external seal assembly 234 engages an intermediate gravel packer 238 and a bottom of the top well screen 232*a*. The top external seal assembly 234 can be a polished bore seal assembly.

The lower portion of the intermediate pin connector with seal assembly 250 is connected to a first intermediate external blank pipe 230*b*; and a second intermediate internal blank pipe 239*c*.

The lower portion of the intermediate pin connector with seal assembly 250 can be connected to the second intermediate internal blank pipe 228*c* and the first intermediate external blank pipe 230*b* by a threaded connection. The second Intermediate internal blank pipe 239*c* can be similar to the production tubing. The first intermediate external blank pipe 230*b* can be similar to the production tubing.

The bottom hydraulically operated tool 215 is connected to a second intermediate internal blank pipe 239*c* and is in communication with a fourth control line 216*d* communicating with the lower tubular portion of the intermediate pin connector 250 and the bottom hydraulically operated tool 215.

A lower well screen 232*b* is secured to the first intermediate external blank pipe 230*b*. The lower well screen 232*b* can be slotted or ribbed. The lower well screen 232*b* is connected to a seal assembly with polished bore 235, that is stung into a lower sealing means 226.

A bottom internal blank pipe 230*d* is connected to the bottom hydraulically operated tool 215 and a bottom isolation seal assembly 242.

The embodied system is repeatable to accommodate additional zones.

While these embodiments have been described with emphasis on the embodiments, it should be understood that within the scope of the appended claims, the embodiments might be practiced other than as specifically described herein.

What is claimed is:

1. A completion system for a well, comprising:

upper production tubing disposed within a wellbore;

an upper packer engaging the upper production tubing;

a top pin connector with seal assembly engaging the upper packer, wherein the top pin connector with seal assembly comprises:

a wet connect assembly, wherein the wet connect assembly comprises:

a lower tubular portion comprising:

a lower tubular body having a lower tubular body face;

a first pin having a first pin outer surface; and a lower hydraulic flow path formed in the lower tubular portion;

an extending hydraulic wet connector for at least partially engaging the lower tubular portion;

an upper tubular portion removably connected to the lower tubular portion, wherein the lower tubular portion comprises:

an upper tubular body for supporting a receiving hydraulic wet connector; and an intermediate hydraulic flow path formed in the upper tubular body fluidly engaging the lower hydraulic flow path;

wherein the receiving hydraulic wet connector engages the upper tubular portion and removably engages the extending hydraulic wet connector;

a seal assembly removably engaging the upper tubular portion, wherein the seal assembly comprises:

a tubular seal assembly body;

an upper hydraulic flow path formed in the tubular seal assembly body fluidly engaging the intermediate hydraulic flow path; and a plurality of upper concentric seals forming a sealing engagement around the upper hydraulic flow path seals;

at least one fastener disposed in:

the lower tubular portion for latching the lower tubular portion to the upper tubular portion;

the upper tubular portion for anchoring the upper tubular portion to another piece of well equipment; and the seal assembly for anchoring the seal assembly to another piece of well equipment or combinations thereof;

a first intermediate production tubing disposed between the top pin connector with seal assembly and a top hydraulically operated tool;

a first control line is secured to a power source and the upper tubular portion of the top pin connector with seal assembly;

a second control line is in communication with the lower tubular portion of the top pin connector with seal assembly and the top hydraulically operated tool;

a second intermediate production tubing is disposed between the top hydraulically operated tool and an intermediate packer;

a third control line is in fluid communication between the top hydraulically operated tool and an upper tubular portion of an intermediate pin connector with seal assembly engaging the intermediate packer;

a fourth control line is in fluid communication between a lower tubular portion of the intermediate pin connector with seal assembly and a bottom hydraulically operated tool;

a first bottom production tubing is disposed between the intermediate pin connector with seal assembly and the bottom hydraulically operated tool; and a second bottom production tubing is disposed between the bottom hydraulically operated tool and a lower sealing means.

2. The system of claim 1, wherein the system of claim 1 is repeatable to accommodate additional wellbore zones.

3. The system of claim 1, wherein each upper tubular portion comprises an upper portion of a locking mechanism connected to each upper tubular body engaging a locking mechanism on each lower tubular body.

4. The system of claim 3, wherein each locking mechanism on each lower tubular body is a collar.

5. The system claim 4, further comprising a lower tubular seal disposed between each collar and each lower tubular portion.

6. The system of claim 4, wherein each collar is disposed around each lower tubular portion.

7. The system of claim 3, wherein the upper portion of each locking mechanism comprises:

a locking key;

a lower key retainer;

a shear pin for engaging the locking key and the lower key retainer;

an upper key retainer for engaging the locking key and the upper tubular portion;

at least one fastener; and a mechanism for exerting a force on the locking key and the upper tubular portion.

8. The system of claim 1, further comprising at least one alignment key at least partially disposed on each lower tubular portion.

9. The system of claim 8, wherein each upper tubular portion comprises at least one alignment groove formed on each upper tubular body for receiving the at least one alignment key.

10. The system of claim 8, wherein each at least one fastener disposed in each lower tubular portion is for anchoring each lower tubular portion to another piece of well equipment.

11. The system of claim 8, wherein each alignment key is disposed on an inner diameter of each tubular body and extending from a top portion of each tubular body no more than 10% of the length of each tubular body.

12. The system of claim 1, further comprising a plurality of upper hydraulic flow path seals between the tubular seal assembly body and each upper tubular body.

13. The system of claim 1, further comprising a plurality of seal assembly fasteners for applying a force to each of the upper hydraulic flow path seals forming a sealing engagement in each upper hydraulic flow path.

14. The system of claim 1, wherein each upper portion is threaded to each lower portion.

15. The system of claim 1, wherein each receiving hydraulic wet connector is a quick release.

16. The system of claim 1, wherein each of the hydraulic flow path seals are non-elastomeric.

17. The system of claim 1, wherein each of the hydraulic flow path seals have different diameters.

18. The system of claim 1, further comprising a second pin surrounding the first pin in each lower tubular portion forming a double pin connector, and wherein each double pin connector is adapted for multi zone gravel packing in a well.

19. The system of claim 1, further comprising a control line connector disposed between each first pin outer surface and each lower tubular body face.

20. The system of claim 1, wherein each seal assembly has a hydraulic flow path plug for providing a sealing engagement with each upper hydraulic flow path and each tubular seal assembly body.

21. The system of claim 1, further comprising at least one seal ring for supporting each at least one upper hydraulic flow path seal.

22. A completion system for a gravel pack well comprising:

an upper production tubing disposed within a wellbore;

an upper gravel packer engaging the upper production tubing;

a top pin connector with seal assembly engaging the upper gravel packer, wherein the top pin connector with seal assembly comprises:

a wet connect assembly, wherein the wet connect assembly comprises:

a lower tubular portion comprising:

a lower tubular body having a lower tubular body face;

a first pin having a first pin outer surface;

a second pin surrounding the first pin; and a lower hydraulic flow path formed in the lower tubular portion;

an extending hydraulic wet connector for at least partially engaging the lower tubular portion;

an upper tubular portion removably connected to the lower tubular portion, wherein the lower tubular portion comprises:

an upper tubular body for supporting a receiving hydraulic wet connector;

an intermediate hydraulic flow path formed in the upper tubular body fluidly engaging the lower hydraulic flow path; and wherein the receiving hydraulic wet connector is for engaging the upper tubular portion and removably engaging the extending hydraulic wet connector;

a seal assembly removably engaging the upper tubular portion, wherein the seal assembly comprises:

a tubular seal assembly body;

an upper hydraulic flow path formed in the tubular seal assembly body fluidly engaging the intermediate hydraulic flow path; and a plurality of upper concentric seals forming a sealing engagement around the upper hydraulic flow path seals; and at least one fastener disposed in:

the lower tubular portion for latching the lower tubular portion to the upper tubular portion;

the upper tubular portion for anchoring the upper tubular portion to another piece of well equipment; and the seal assembly for anchoring the seal assembly to another piece of well equipment or combinations thereof;

wherein the lower tubular portion of the top pin connector with seal assembly is connected to a top external blank pipe and a top internal blank pipe; wherein:

the upper tubular portion of the top pin connector is in fluid communication with a first control line secured to a power source;

a top hydraulically operated tool is connected to the top external blank pipe and is in fluid communication with a second control line in fluid communication with the lower tubular portion of the top pin connector for periodically controlling the top hydraulically operated tool;

a top well screen is secured to the top external blank pipe; and a top external seal assembly engages an intermediate gravel packer and a bottom of the top well screen;

a first intermediate blank pipe is connected to the top hydraulically operated tool and the upper tubular portion of an intermediate pin connector with seal assembly engaging the intermediate packer;

a third control line is in fluid communication the top hydraulically operated tool and the upper tubular portion of the intermediate pin connector with seal assembly;

the lower tubular portion of the intermediate pin connector with seal assembly is connected to a first intermediate external blank pipe and a second intermediate internal blank pipe is connected to a bottom hydraulically operated tool;

a bottom internal blank pipe is connected to the bottom hydraulically operated tool and a bottom isolation seal assembly;

a fourth control line is in fluid communication with the lower tubular portion of the intermediate pin connector and the bottom hydraulically operated tool;

a lower well screen is secured to the first intermediate external blank pipe; and a seal assembly with a polished bore is secured to the lower well screen and secured to a lower sealing means.

23. The system of claim 22, wherein the system of claim 22 is repeatable to accommodate additional wellbore zones.

24. The system of claim 22, wherein each upper tubular portion comprises an upper portion of a locking mechanism connected to each upper tubular body engaging a locking mechanism on each lower tubular body.

25. The system of claim 24, wherein each locking mechanism on each lower tubular body is a collar.

26. The system claim 25, further comprising a lower tubular seal disposed between each collar and each lower tubular portion.

27. The system of claim 26, wherein each collar is disposed around each lower tubular portion.

28. The system of claim 24, wherein the upper portion of each locking mechanism comprises:

a locking key;

a lower key retainer;

a shear pin for engaging the locking key and the lower key retainer;

an upper key retainer for engaging the locking key and the upper tubular portion;

at least one fastener; and a mechanism for exerting a force on the locking key and the upper tubular portion.

29. The system of claim 22, further comprising at least one alignment key at least partially disposed on each lower tubular portion.

30. The system of claim 29, wherein each upper tubular portion comprises at least one alignment groove formed on each upper tubular body for receiving the at least one alignment key.

31. The system of claim 29, wherein each alignment key is disposed on an inner diameter of each tubular body and extending from a top portion of each tubular body no more than 10% of the length of each tubular body.

32. The system of claim 22, further comprising a plurality of upper hydraulic flow path seals between the tubular seal assembly body and each upper tubular body.

33. The system of claim 22, wherein each at least one fastener disposed in each lower tubular portion is for anchoring each lower tubular portion to another piece of well equipment.

34. The system of claim 22, further comprising a plurality of seal assembly fasteners for applying a force to each of the upper hydraulic flow path seals forming a sealing engagement in each upper hydraulic flow path.

35. The system of claim 22, wherein each upper portion is threaded to each lower portion.

36. The system of claim 22, wherein each receiving hydraulic wet connector is a quick release.

37. The system of claim 22, wherein each of the hydraulic flow path seals are non-elastomeric.

38. The system of claim 22, wherein each of the hydraulic flow path seals have different diameters.

39. The system of claim 22, further comprising a control line connector disposed between each first pin outer surface and each lower tubular body face.

40. The system of claim 22, wherein each seal assembly has a hydraulic flow path plug for providing a sealing engagement with each upper hydraulic flow path and each tubular seal assembly body.

41. The system of claim 22, further comprising at least one seal ring for supporting each at least one upper hydraulic flow path seal.

* * * * *